US010974114B2

(12) United States Patent
Kwiatek

(10) Patent No.: US 10,974,114 B2
(45) Date of Patent: Apr. 13, 2021

(54) TOSS GAME

(71) Applicant: Anthony John Kwiatek, Wilmington, NC (US)

(72) Inventor: Anthony John Kwiatek, Wilmington, NC (US)

( * ) Notice: Subject to any disclaimer, the term of this patent is extended or adjusted under 35 U.S.C. 154(b) by 0 days.

(21) Appl. No.: 16/715,297

(22) Filed: Dec. 16, 2019

(65) Prior Publication Data

US 2020/0188753 A1 Jun. 18, 2020

Related U.S. Application Data

(60) Provisional application No. 62/781,463, filed on Dec. 18, 2018.

(51) Int. Cl.
*A63B 63/00* (2006.01)
*A63B 67/06* (2006.01)

(52) U.S. Cl.
CPC ..... *A63B 67/06* (2013.01); *A63B 63/00* (2013.01)

(58) Field of Classification Search
CPC ..... A63B 67/06; A63B 63/00
USPC ..... 273/348, 398, 400, 401, 407
See application file for complete search history.

(56) References Cited

U.S. PATENT DOCUMENTS 1,211,379 A * 1/1917 Maisch ..... A63F 9/02 273/368
3,201,126 A * 8/1965 Nissen ..... A63B 5/11 273/393
3,430,958 A * 3/1969 Lakeman ..... A63B 63/08 473/481
4,133,526 A * 1/1979 Anson ..... A63B 67/10 273/441
4,299,394 A * 11/1981 Greenspan ..... A63F 9/0278 273/348
4,943,066 A * 7/1990 Lathim ..... A63B 37/02 473/576
5,230,650 A * 7/1993 Brayton ..... A63B 67/06 446/219
5,813,931 A * 9/1998 Gormley ..... A63B 43/00 473/575
10,525,319 B1 * 1/2020 Sabo ..... A63B 67/002
2003/0025272 A1 * 2/2003 Billig ..... A63B 63/00 273/400
2006/0178237 A1 * 8/2006 Roust ..... A63B 43/02 473/576
2012/0169012 A1 * 7/2012 Parker ..... A63B 67/002 273/400
2012/0225742 A1 * 9/2012 Max ..... A63B 67/002 473/481
2015/0367216 A1 * 12/2015 Todd ..... A63B 67/06 273/400

(Continued)

*Primary Examiner* — Raleigh W Chiu
(74) *Attorney, Agent, or Firm* — NK Patent Law

(57) ABSTRACT

A toss game target assembly includes a first target platform having a frame, multiple legs supporting the frame, and a first target surface supported by the frame. The first target surface has a first target hole for receipt of a projectile. A column supports a second target structure for receipt of a projectile above the first target surface. The first target surface may be a taut flexible mat. The second target structure may include a net. A multiplayer game system includes two of the target assemblies, and multiple projectiles each having a flexible tassel assembly attached to a deformable ball.

14 Claims, 4 Drawing Sheets

(56) References Cited

U.S. PATENT DOCUMENTS

| | | | | |
|---|---|---|---|---|
| 2016/0023074 | A1* | 1/2016 | Girman | A63B 67/06<br>273/336 |
| 2017/0354855 | A1* | 12/2017 | Cullen | A63B 63/08 |
| 2018/0078837 | A1* | 3/2018 | Tripp | A63B 71/023 |
| 2019/0329108 | A1* | 10/2019 | Cabral | A63B 67/06 |
| 2019/0388750 | A1* | 12/2019 | Sullivan | A63B 63/00 |
| 2020/0001157 | A1* | 1/2020 | Galian | A63B 67/06 |
| 2020/0094120 | A1* | 3/2020 | LeHardy | A63B 71/0036 |
| 2020/0188753 | A1* | 6/2020 | Kwiatek | A63B 63/00 |

* cited by examiner

TOSS GAME

CROSS-REFERENCE TO RELATED APPLICATION

This application claims the benefit of priority of U.S. provisional patent application No. 62/781,463 titled "FLINGBALL GAME," filed on Dec. 18, 2018, which is incorporated herein in its entirety by this reference.

TECHNICAL FIELD

The present disclosure relates to physical games. More particularly, the present disclosure relates to games in which a projectile is tossed by players toward a multi-tiered target assembly.

BACKGROUND

Games are popular for recreation among friends and for developing and keeping motor skills, dexterity, and coordination. Physical games are beneficial over video game systems toward encouraging direct interpersonal interactions. Some games may be limited to strictly outdoor play due to design, and so are limited for use in amenable weather and require large open spaces. Some recreational activities such as bowling require large dedicated facilities.

Families and friends are in need of improved game systems that are fun, safe to use, affordable, and portable.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

According to at least one embodiment, a toss game target assembly includes: a first target platform including a frame, multiple legs supporting the frame, and a first target surface supported by the frame, the first target surface having a first target hole for receipt of a projectile; at least one support column; and a second target structure for receipt of a projectile above the first target surface, the second target structure supported by the support column.

In at least one example, the first target surface has an opening spaced from the first target hole, and a tubular portion of the support column extends through the opening.

The first target surface may be defined by a taut flexible mat.

A periphery of the mat may be attached to the frame, with the frame tensioning the mat.

In at least on example, resilient members attach the periphery of the mat to the frame, such that the frame and resilient members tension the mat.

The second target structure may include a net.

The second target structure may include a peripheral frame supported by the support column, with an outer periphery of the net being attached to the frame.

The net may include an inner perimeter through which the support column extends.

An upper end of the support column may have an upwardly directed target opening.

The upper end of the support column may be diametrically enlarged relative to a lower portion thereof.

According to at least one embodiment, a multi-player game system includes a first target assembly and a second target assembly. Each target assembly includes: a target platform including a frame, multiple legs supporting the frame, and a target surface supported by the frame, the target surface having a target hole for receipt of a projectile; at least one support column; and a target structure for receipt of a projectile above the target surface, the second target structure supported by the support column. Multiple projectiles each include at least a ball and a flexible tassel assembly attached to the ball.

The ball may include a flexible shell at least partially filled with granular elements.

The first target assembly and second target assembly can be arranged for game play such that the target holes and support columns are all along a common straight line with each other.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
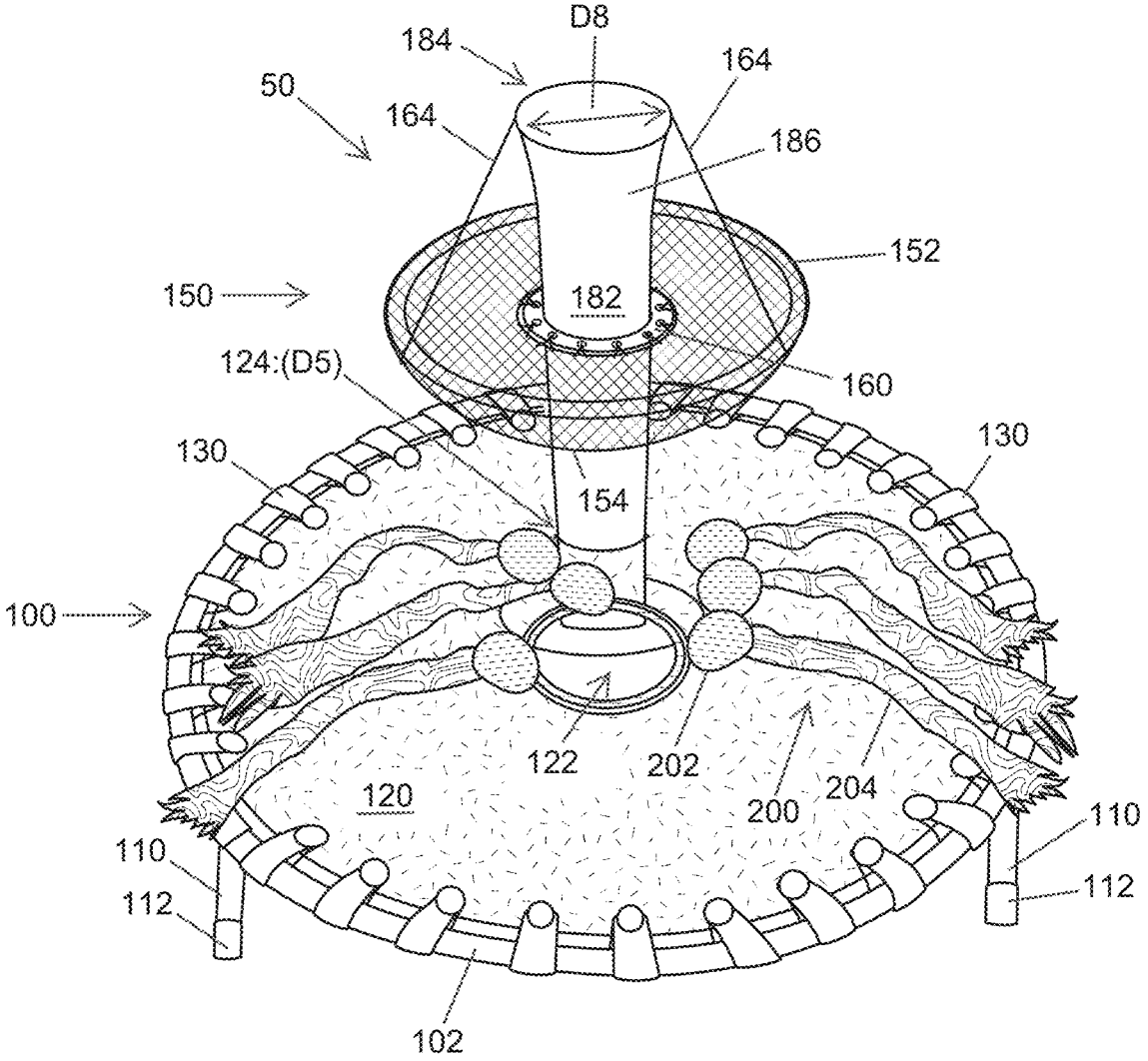
FIG. 1 is a perspective view of a target assembly for a projectile toss game, according to at least one embodiment.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Figure 2:
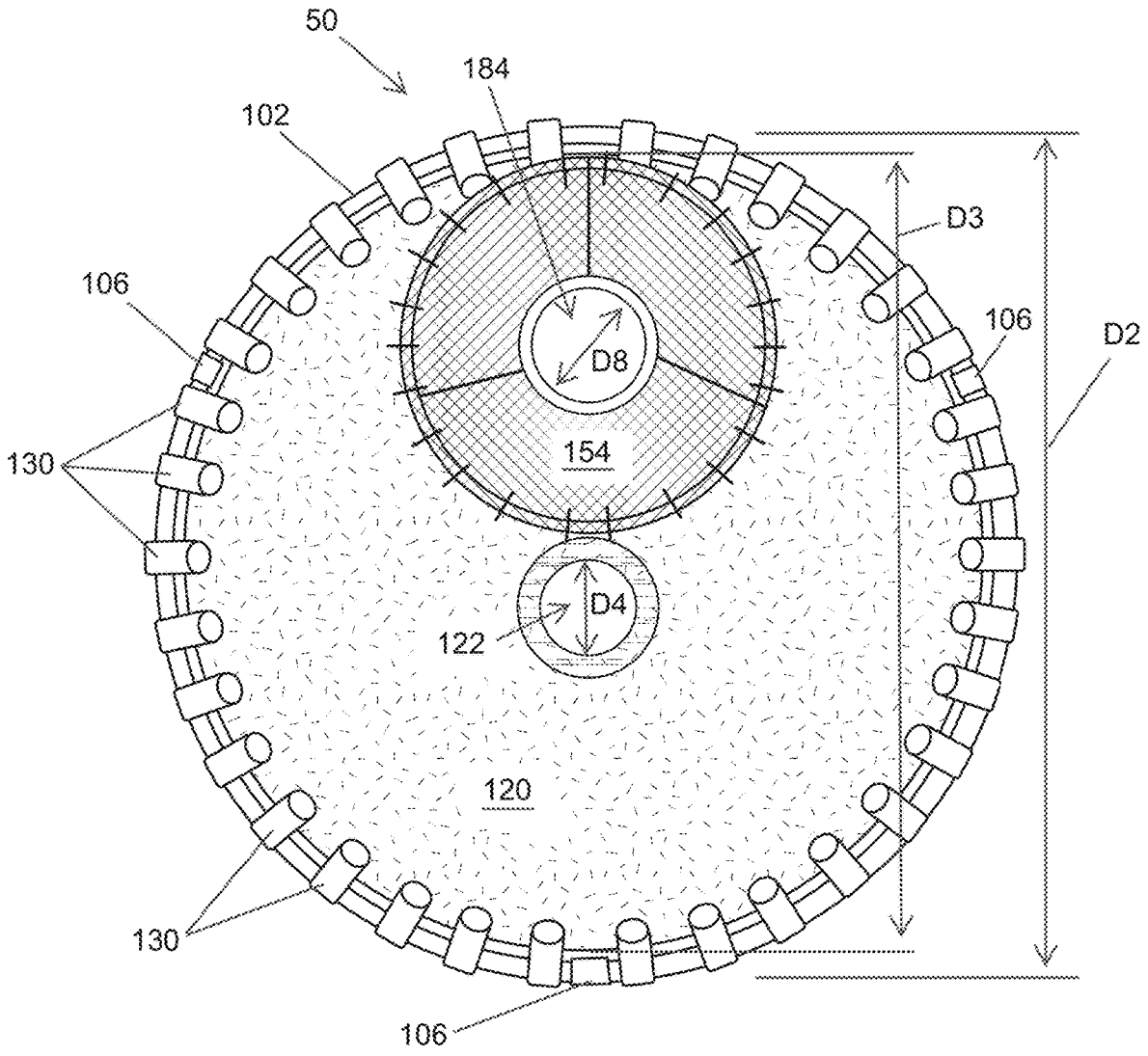
FIG. 2 is a plan view of the target assembly of FIG. 1.

A multi-tiered target assembly 50 for use in playing a toss game, according to at least one embodiment, is shown in FIG. 1. The low-tier or first-tier target platform 100 of the target assembly 50 has a raised peripheral frame 102, which may be constructed as a tubular (solid or conduit) ring as illustrated in FIG. 1. The frame 102 may be made with rigid metal, plastic or other material. As a non-limiting example, the frame 102 can be made from three-quarters to one inch diameter D1 (FIG. 4) conduit formed into a circle approximately forty two inches in diameter D2 (FIG. 2). The frame 102 can be a smaller or larger circle, or square or other geometric shape as well. All dimensions and distances may vary among embodiments. The dimensions particularly provided as non-limiting examples in these descriptions apply to a "particular described embodiment," which is referenced herein to provide a complete description of one particular implementation.

The frame 102 may be segmented, for example with two or more sections which easily connect together by mechanical joints such as slip connectors 106 (FIG. 2). Three sections of the frame 102 are shown as joined by three connectors in FIG. 2 as a non-limiting example. Other connectors such as taper connectors, push button spring clips, and sleeve connectors, can be used. The frame 102, in segmented embodiments, can come apart to reduce the size for packaging and/or storage.

The frame 102 is supported by three or more legs 110, which can be made for example from tubular or solid steel, plastic or other materials. Each leg may have a cap 112 on its lower end. The cap 112 can be made from rubber, plastic or other materials. The caps 112 serve to prevent foreign material from entering legs 110, to protect the leg material from corrosion, and to help with grip on the surface upon which the target assembly rests and to protect support surfaces such as floors from being scratched during game play or when moving the target assembly.

Figure 3:
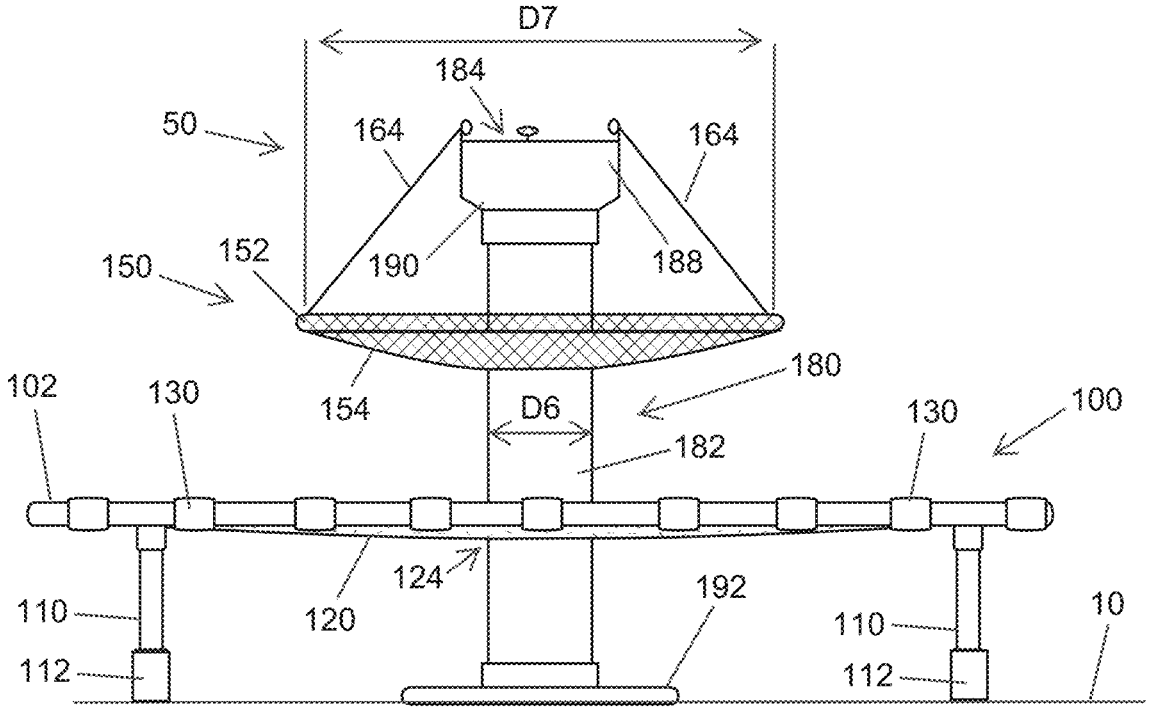
FIG. 3 is a front elevation view of a target assembly according to at least one embodiment.

The legs 110 connect to the frame 102 in a perpendicular fashion and may be spaced equally around the perimeter to raise the first-tier platform 100 above the surface 10, such as a floor, over which a toss game facilitated by the target assembly 50 is played. The first-tier platform 100 may be raised, for example, approximately six (or less) to eight inches (or more) from the surface 10 (FIG. 3). The legs 110 can be adjustable in length or angle by mechanical adjusters (telescoping, rotating from the perpendicular position, by connection, etc.) so that the frame 102 and platform 100 may be leveled if set on an un-level surface.

Attached to, centered in, and supported by, the frame 102 is the first-tier target surface, defined in the illustrated embodiment by a taut flexible mat 120 (FIGS. 1-2). The mat 120 is circular in the illustrated embodiment, having a diameter D3 (FIG. 2), which is approximately thirty eight inches in the particular described embodiment. A variety of sizes in diameter or other geometric shapes for the first-tier target mat to match the frame may be provided in other embodiments. The mat 120 can be made of fabric. For example, polypropylene fabric can be used, thickly woven to make a bouncy webbed fabric. For further examples, a fiberglass screen mesh or other materials can be used. The first-tier target mat 120 has a first-tier target hole 122 at or near the geometric center of mat 120. The target hole 122 has a diameter D4 (FIG. 2), which is approximately four inches in the particular described embodiment. The mat 120 has a non-central opening 124 (FIG. 1) spaced from the target hole 122 and having a diameter of D5. In the particular described embodiment, the opening 124 has a diameter (D5) of approximately five inches and is ten to eleven inches from the center of the mat 120, offset therefrom and thus closer to the outer edge of the mat 120. The diameters and positions provided as example may vary in different embodiments.

Figure 4:
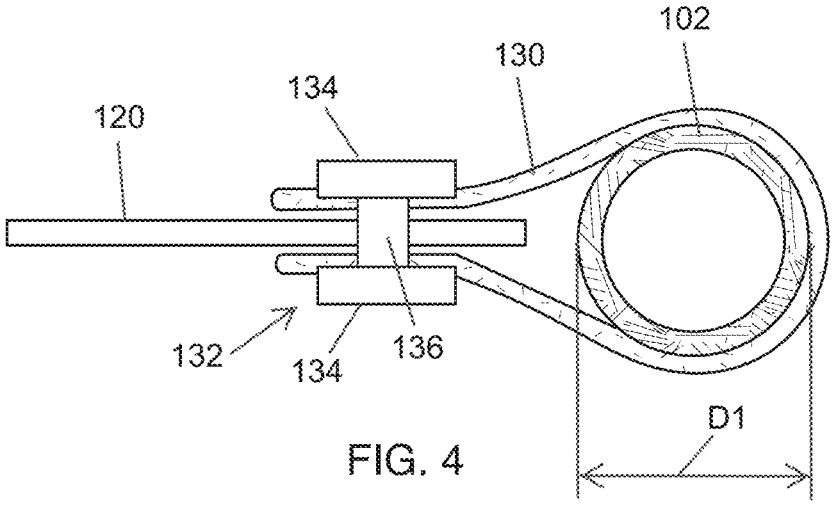
FIG. 4 is a partial cross sectional view of an edge portion of a first-tier target platform, according to at least one embodiment.

As shown in FIG. 4, the periphery of the mat 120 is attached to the frame 102 with resilient members referenced as strips 130 of elastic band or flexible/stretchable material. The particular described embodiment uses a flat elastic fabric as the strips 130, which can be for example, one to two inches wide. The strips 130 are illustrated as looped around the frame 102, with the strips positioned approximately every two to three inches along the frame 102. The ends of each strip 130, in the illustrated embodiment, are fastened together with a peripheral portion of the mat 120 sandwiched in between. A fastener such a rivet or grommet can be used to fasten the ends of the strip 130. For example, as shown in FIG. 4, a fastener 132, representing a rivet or grommet or other two-headed connector, has two wide heads 134 connected by a central more narrow shaft 136 passing through the ends of the strip 130 and mat 120. In other embodiments, the mat 120 is attached directly, for example sewn, sleeved, or bonded, to the frame 102, which directly tensions the mat 120.

In other embodiments, the mat 120 and flexible/stretchable strips 130 can be sewn, stapled, or fastened by other mechanical connection or chemical bond. This mat 120 with the looped strips 130 or strips of flexible/stretchable material can be made as one assembly. The segments of the frame can be threaded through the elastic loops or connected to the flexible/stretchable material and then connected together to form the continuous (closed) frame 102 and to keep the mat 120 material taut (like a trampoline). Thus, the strips 130 and frame 102 tension the flexible mat 120. The geometric shape, size, materials and quantities used for the first-tier platform 100 described above may vary from the particular described embodiment.

The target assembly 50 further has a middle tier or second tier target structure 150 supported above the first-tier platform 100 by a support column 180 (FIG. 3). The support column 180 includes a vertical hollow tubular portion, referenced as tube 182, having a diameter D6. The tube 182 of the support column 180 extends through the opening 124. In the particular described embodiment, the tube 182 is approximately twenty inches long and four inches in diameter (D6). The second tier target structure 150 includes a raised peripheral frame 152, which is circular in the illustrated embodiment, having a diameter D7 (FIG. 3). In the particular described embodiment, the frame 152 is constructed with a tubular conduit material and has a diameter (D7) of approximately twenty inches. The frame 152 is rigid, and can be made from metal, plastic or other material, for example a conduit having a one-half to three-quarter inch cross section diameter could be used to form the circular frame 152.

The second tier target structure 150 includes an annular net 154, which has an outer periphery attached to the frame 152. A gasket 160 (FIG. 1) is attached to the inner periphery of the net 154. The gasket 160 can be flat, concave or convex, and can be constructed, as a non-limiting example, from a rubber ring. The gasket 160 has a central opening that accommodates the tube 182. The second tier target structure 150 is centered in and attached to the frame 152 along the outer periphery of the annular net 154. The net 154 is loosely supported (not taut) by the frame 152, and hangs or sags downward from the frame 152 and toward the tube 182 of the support column 180, which extends through the gasket 160 and inner periphery of the net.

The net 154 can be made of a nylon mesh material, having openings or holes in the mesh. The openings or holes may be dimensioned about one-quarter inch as a non-limiting example. The net 154 slips over the tube 182 and rests approximately six inches down from the top of the tube 182 in the particular described embodiment. The gasket 160 receives the tube 182 and holds the inner periphery of the net 154 below the frame 152 by a snug engagement with the tube 182. For example, the central opening of the gasket that receives the tube 182 may have a natural unstretched diameter of approximately 3.5 inches to engage and accommodate the tube in an embodiment in which the tube 182 has a four inch diameter (D6).

The second tier target structure 150 includes, in the illustrated example, linear supports 164 (FIGS. 1,3) having upper ends attached to the support column 180 and lower ends attached to the frame 152, thereby supporting the frame 152 and net 154 from above. The supports 164 may be, for example, wires, rods, or tubes, as non-limiting examples. The supports 164 may be rigid to limit or prevent the frame 152 from tipping or rocking during game play.

The upper end of the support column 180 is flared or diametrically enlarged relative to the tube 182 along its general lower length. The upper end of the support column 180 has an upwardly directed opening 184 that constitutes a high or third-tier target, having a diameter D8. FIGS. 1 and 3 represent different embodiments with regard to the upper end of the support column 180. In either example (FIG. 1 or FIG. 3), at the upper end of the support column 180, the third-tier target opening can have a diameter (D8) of six inches. The terms low, middle, and high are relative terms used herein to describe the tiers with regard to their relative vertical heights, with the middle or second tier generally above the low or first tier, and the high or third tier generally above the second tier.

In FIG. 1, the tube 182 has an upper section 186 that smoothly tapers (reduces) diametrically from the relatively larger top target opening 184 to a lower section of the tube 182 proximate the gasket 160 of the second-tier target structure 150. In this embodiment, the tube 182, including the upper section 186, can be formed of plastic in a materially contiguous unitary form. The tapered upper section 186, in at least one embodiment, extends approximately six inches from the cylindrical tube 182 portion to the top target opening 184.

In FIG. 3, a top cylindrical tube segment 188, having the diameter D8, serves as the upper end of the support column 180. The open upper end of the tube segment 188 provides the third-tier top target opening 184. In this illustrated embodiment, a tapered adapter segment 190 attaches the lower end of the tube segment 188 to the upper end of the cylindrical tube 182. As non-limiting examples, the tube 182, the tube segment 188, and the tapered adapter segment 190 can be constructed of rigid plastic, and are tightly fitting and/or bonded at their respective junctions. In at least one embodiment, the top cylindrical tube segment 188 and tapered segment 190 have a combined length from the target opening 184 to the cylindrical tube 182 of approximately six inches.

To assemble the target assembly 50, the tube 182, with the second tier target structure 150 attached, can be inserted into the opening 124 in the mat 120. The lower end of the tube 182 can be engaged with a base flange 192 (FIG. 3), which has a larger diameter, which can be six to twelve or more inches in the particular described embodiment. The base flange 192 has a sleeve or hole to receive and retain the lower end of the tube 182. This holds the support column 180 in place to stabilize the assembly to keep it from tipping over during game play. The geometric shape, size, materials and quantities used for the first, second and third tier targets described above may vary.

The projectiles 200, which the target assembly 50 receives during game play, are shown in the illustrated embodiment (FIGS. 1 and 6), as flingballs. Each projectile 200 as illustrated includes a deformable ball 202 and a flexible tassel assembly 204 attached to the ball. In at least one example of a game, six projectiles are used. For example, each of two players may use three projectiles 200. As a non-limiting example, the ball 202 can be made using a flexible shell filled with granular elements. For example a nylon fabric shell can be filled with plastic beads, nylon stuffing, and/or other materials. The shell, for example, may be approximately spherical, having a diameter of approximately three inches. The ball 202, as stuffed, may weigh approximately six ounces as a non-limiting example.

The tassel assembly 204, may be, as a non-limiting example, fourteen to sixteen inches long. The tassel assembly can be made from a variety of materials such as strands of yarn (about twenty eight individual strands in an exemplary embodiment), plastic strips, cotton string, etc. The tassel assembly 204 may be tied into a knot or 'gobbed' on one end that is sewn into or attached to the fabric ball 202, to keep it from pulling out of the ball or becoming detached during throwing/flinging. The geometric shape, size, materials and quantities used for the projectiles 200 described above may vary.

Figure 5:
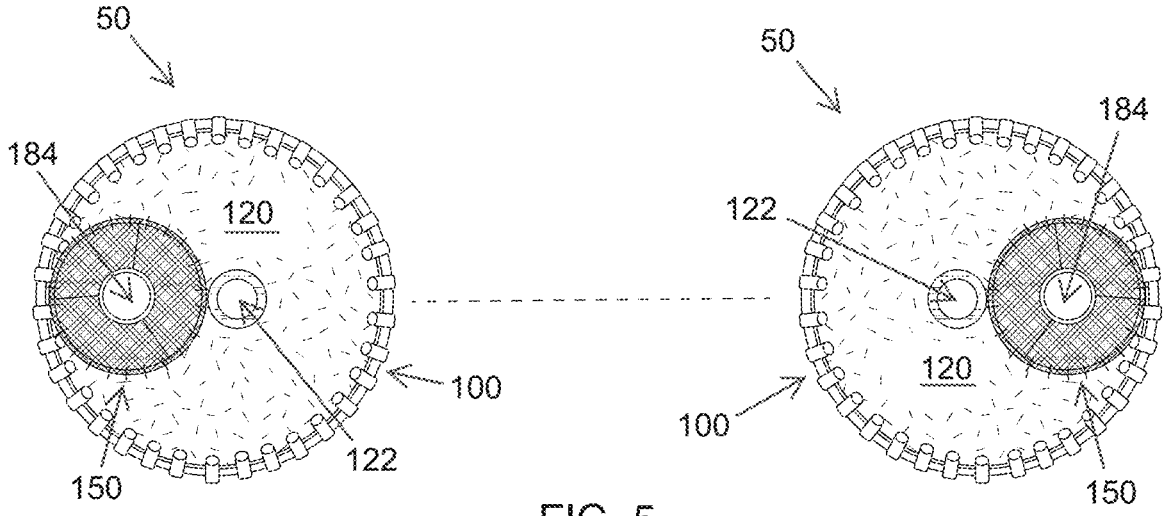
FIG. 5 is an overhead view of a projectile toss game arrangement having two target assemblies.
Figure 6:
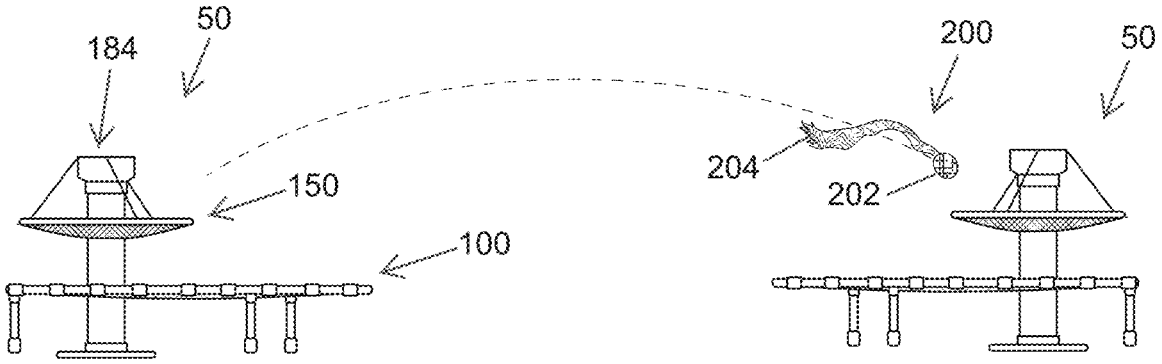
FIG. 6 is a side elevation view of the game arrangement of FIG. 5, shown with a projectile in flight.

A particular method of gaming is described in the following as a non-limiting example of a multi-player game conducted by use of two target assemblies 50 in a game system arrangement represented in FIGS. 5 and 6, in which the distances between the two target assemblies are not necessarily to scale. A game using two target assemblies can be played with multiple players, which can be two opponents or two opposing teams each having multiple team members. The following expressly describes two opposing players, but relates as well to teams playing against each other. Each player (or team) will have three projectiles which they will use to "fling' onto the target assembly 50. The two target assemblies are placed on the ground (surface) 20 to 30 feet apart facing each other in an orientation with the second and third tier target toward the back of each and the first-tier target hole 122 toward the front—meaning the target hole 122 of each target assembly 50 are the closest distance together and the second and third tier target assemblies are furthest from each other. The targets should align with each other for game play so that the target holes 122 and the support columns 180 (as represented in FIG. 5 by the third-tier target openings 184) of the two target assemblies 50 are all along a common straight line with each other as shown in FIG. 5. FIGS. 5 and 6 represent such an arrangement, with the distance between the target assemblies 50 being out of scale (compressed) for purpose of illustration.

The target assemblies 50 should be level with the surface which they rest on. Each player will take alternating turns 'flinging' their projectiles toward their target assembly 50. (The act of flinging the projectile is to grasp the tassel end in your throwing hand, and swing/fling the ball attached to it, release it from your grip toward the target in an upward arc so that it may land on the desired area being aimed for.

The object of the particularly described game is to be the first player to reach thirteen points. This is accomplished by flinging the projectile toward the target assembly 50 opposite the player.

The mat 120 has at least two possible point awards. If the player's projectile 200 lands on the first-tier target platform 100 and stays on it, the player will be awarded one point. In the event that the projectile 200 is hanging by its tassel 204, but the ball 202 is not touching the surface (or ground), then the player is still awarded one point. If the ball 202 goes into the target hole 122, the player is awarded two points. The entire projectile 200 need not be completely in the hole 122. In other words, it still counts for two points if the tassel 204 is not fully in the hole 122. This could be accomplished by either landing on the first-tier target platform 100 of the target or bouncing off of the ground or surface and up onto the first-tier target platform 100.

If the player's projectile lands in the second tier target structure 150 and stays, the player is awarded three points. If the projectile lands in the second-tier target structure 150 but falls out and is hanging by its tassel, then the player is still awarded three points as long as the ball part is not touching the first-tier target platform 100. If the ball 202 is touching the first-tier target platform 100, particularly the mat 120, then only one point will be awarded. One other way this could also be accomplished, is by causing the projectile 200 to land on the mat 120 of the target structure 150 and then bounce up into the second tier target.

If the player's projectile lands in the third-tier target opening 184, the player is awarded five points if it stays. If the projectile is hanging from the top tier target by its tassel, and the ball part is touching the net 154 of the frame 152 (the second-tier target structure 150) then only three points will be awarded. Otherwise, if it is not touching then the player is still awarded five points. One other way this could also be accomplished, is by causing the projectile to land on the mat 120 and then bounce up into the third tier target.

There may be many tactics to winning the game (being the first person to reach thirteen points). In general, the player will fling the projectile by its tassel toward the target, which is 20 to 30 feet away from them, in an upward arc through the air so as to have it land in the desired area of the target at which the player is aiming for.

The rules of the game can be as follows. The player's feet must remain behind the center of the opponents target when flinging their ball toward their target. The players must fling the projectile by its tassel only. In other words, no throwing by the ball part of the projectile. The opposing player (to the person flinging the projectile) can not interfere with that person, their projectile or the targets during the game. The interference penalty will result in a five point loss for the person interfering for each offense.

The players can determine who goes first initially by agreement or by flipping a coin, or they may fling one projectile each at the opposing target and the player with the most points can decide who goes first. Each player can alternate flinging the projectile toward their target until all three projectiles are thrown. Then the points are tallied up for each round and accumulated throughout the game. The first person to reach thirteen points (or more) wins the game. In another example of gaming using target assemblies 50, gaming continues until a player reaches twenty one (or more).

In a variant of multiplayer gaming with four players (two on two), a member of each team is positioned at opposite target assemblies and the teammate at the receiving end target has the opportunity to "hacky" (use their foot to kick) the projectile back toward the receiving end target for possible points for his teammate, in the event that their teammate misses the target altogether.

The object of the game and the rules described above are general in nature and variations of the game, object of the game and rules (including distances, number of players, points to win, etc.) may be discovered and implemented as part of the game.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A toss game target assembly comprising:

a first target platform including a frame, multiple legs supporting the frame, and a flexible mat defining a first target surface supported by the frame, the first target surface having a circular first target hole for receipt of a projectile;

at least one support column; and a target structure for receipt of a projectile above the first target surface, the target structure supported by the support column;

wherein the first target surface has a non-central opening spaced from the first target hole, wherein a tubular portion of the support column extends through the opening, wherein a periphery of the mat is attached to the frame, and wherein the frame tensions the mat.

2. The toss game target assembly of claim 1, further comprising resilient members by which the periphery of the mat is attached to the frame, and wherein the frame and resilient members tension the mat.

3. The toss game target assembly of claim 1, wherein the target structure comprises a net.

4. The toss game target assembly of claim 3, wherein the target structure comprises a peripheral frame supported by the support column, and an outer periphery of the net is attached to the frame of the target structure.

5. The toss game target assembly of claim 4, wherein the net comprises an inner perimeter through which the support column extends.

6. The toss game target assembly of claim 1, wherein an upper end of the support column has an upwardly directed target opening.

7. The toss game target assembly of claim 6, wherein the upper end of the support column is diametrically enlarged relative to a lower portion thereof.

8. A multi-player game system comprising:

a first target assembly and a second target assembly, each comprising:

a target platform including a frame, multiple legs supporting the frame, and a flexible mat defining a target surface supported by the frame, the target surface having a circular target hole for receipt of a projectile;

at least one support column; and a target structure for receipt of a projectile above the target surface, the second target structure supported by the support column, wherein the target surface has a non-central opening spaced from the target hole, wherein a tubular portion of the support column extends through the opening, wherein a periphery of the mat is attached to the frame, and wherein the frame tensions the mat, and multiple projectiles, each including at least a ball and a flexible tassel assembly attached to the ball.

9. The game system of claim 8, wherein the ball comprises a flexible shell at least partially filled with granular elements.

10. The game system of claim 8, wherein the target structure comprises a net.

11. The game system of claim 10, wherein the target structure comprises a peripheral frame supported by the support column, and an outer periphery of the net is attached to the frame.

12. The game system of claim 8, wherein an upper end of the support column has an upwardly directed target opening.

13. The game system of claim 12, wherein the upper end of the support column is diametrically enlarged relative to a lower portion thereof.

14. The game system of claim 8, wherein the first target assembly and second target assembly are arranged such that the target holes and support columns are all along a common straight line with each other.

* * * * *